US010788289B1

(12) United States Patent
Wallace et al.

(10) Patent No.: US 10,788,289 B1
(45) Date of Patent: Sep. 29, 2020

(54) FIREARM TRAINING DEVICE

(71) Applicant: LASR Team, LLC, Lincoln, NE (US)

(72) Inventors: John William Wallace, Palmyra, NE (US); Jason Daniel Williams, Lincoln, NE (US)

(73) Assignee: LASR Team, LLC, Lincoln, NE (US)

( * ) Notice: Subject to any disclaimer, the term of this patent is extended or adjusted under 35 U.S.C. 154(b) by 334 days.

(21) Appl. No.: 15/899,237

(22) Filed: Feb. 19, 2018

Related U.S. Application Data

(60) Provisional application No. 62/464,714, filed on Feb. 28, 2017.

(51) Int. Cl.
*F41G 3/26* (2006.01)
*F41A 33/02* (2006.01)

(52) U.S. Cl.
CPC ..... *F41G 3/2605* (2013.01); *F41A 33/02* (2013.01)

(58) Field of Classification Search
CPC ..... F41A 33/00; F41A 33/02; F41A 33/04; F41A 33/06; F41G 3/26; F41G 3/2605; F41G 3/2622
See application file for complete search history.

(56) References Cited

U.S. PATENT DOCUMENTS 8,496,480 B2 * 7/2013 Guissin ..... F41A 33/00 434/11
2015/0023591 A1 * 1/2015 Potluri ..... F41J 5/10 382/162
2017/0307332 A1 * 10/2017 Ooi ..... F41G 3/12

* cited by examiner

*Primary Examiner* — Timothy A Musselman
(74) *Attorney, Agent, or Firm* — Nasr Patent Law LLC; Faisal K. Abou-Nasr

(57) ABSTRACT

A firearm training device can include a firearm frame that has a barrel with a camera disposed at a distal end of the barrel, a grip attached to the barrel, and a trigger in proximity to the grip. The trigger can be configured to toggle an electronic switch. The firearm frame can also include a controller communicatively coupled to the camera and the electronic switch. The controller can be configured to collect an image frame or video segment, via the camera, when the electronic switch is toggled, and generate a composite image or video including the image frame or video segment and a strike indicator overlaid onto the image frame or video segment, whereby the composite image or video demonstrates where a firearm strike would have occurred. In other embodiments, the firearm training device is configured as an attachment for a firearm (e.g., a live firearm or mock firearm).

20 Claims, 13 Drawing Sheets

FIREARM TRAINING DEVICE

CROSS-REFERENCE TO RELATED APPLICATIONS

The present application claims the benefit under 35 U.S.C. § 119(e) of U.S. Provisional Application Ser. No. 62/464,714, filed Feb. 28, 2017, and titled "FIREARM TRAINING DEVICE," which is incorporated herein by reference in its entirety.

BACKGROUND

Firearm training is widely used to develop judgment, safety, accuracy, and techniques in utilizing firearms. Live fire practice is the traditional training method. Live fire practice involves shooting live ammunition in a practice setting (e.g., shooting range). Shooters often use paper or steel targets to provide feedback on their performance. However, live fire practice can present difficulties due to time and monetary constraints. For example, the expense of ammunition may be cost prohibitive for some shooters. Further, safety restrictions on live fire practice at shooting ranges keep people from practicing important aspects of firearm handling.

Dry fire practice is firearm training without the use of live ammunition. There are many types of dry fire practice. In its simplest form, a shooter can practice handling and shooting the firearm without ammunition or training aids. This method can be cost effective, but fails to provide feedback to the shooter.

SUMMARY

Firearm training devices are described herein. In some embodiments, the firearm training device comprises a firearm frame including a barrel having a camera disposed at a distal end. The firearm frame further includes a grip attached to the barrel and a trigger in proximity to the grip. In embodiments, the trigger can be configured to toggle an electronic switch. The firearm frame can also include a controller communicatively coupled to the camera and the electronic switch. The controller is configured to collect an image frame or video segment, via the camera, when the electronic switch is toggled, and generate a composite image or video including the image frame or video segment and a strike indicator overlaid onto the image frame or video segment, whereby the composite image or video demonstrates where a firearm strike would have occurred. In other embodiments, the firearm training device comprises an attachment for a firearm (e.g., a live firearm or mock firearm).

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. The use of the same reference numbers in different instances in the description and the figures may indicate similar or identical items. Various embodiments or examples ("examples") of the present disclosure are disclosed in the following detailed description and the accompanying drawings. The drawings are not necessarily to scale. In general, operations of disclosed processes may be performed in an arbitrary order, unless otherwise provided in the claims.

DETAILED DESCRIPTION

Overview

Figure 1:
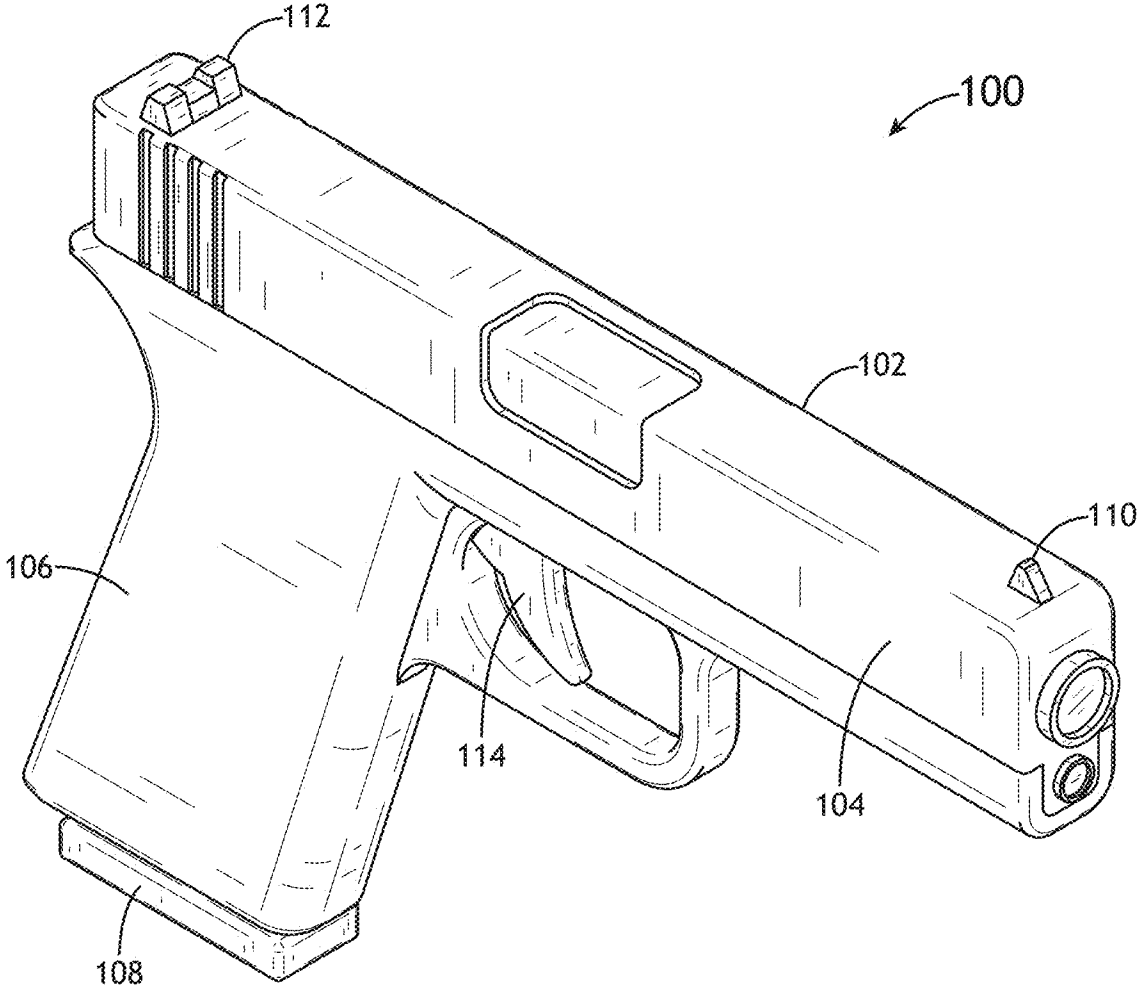
FIG. 1 is a perspective view of a firearm training device, in accordance with an embodiment of the present disclosure.

Some types of dry fire practice utilize a light source (e.g., laser) to provide visual feedback to the shooter, indicating where a firearm strike would have occurred. There are many types of lasers that can be used for dry fire practice, but all function in a relatively similar way—they emit a laser when the trigger of the firearm is pulled. These lasers are commonly called "training aids" because they provide feedback to the shooter. For example the laser can indicate a point of impact based on the shooter's aim when the laser was activated (e.g., when the trigger was pulled). However, the usefulness of that feedback is limited by the short duration for which the laser is emitted. The training aids typically only emit a laser for a fraction of a second, making it difficult to track the point of impact.

Some types of dry fire practice include a laser training aid paired with simulation software. These systems are often utilized for military and law enforcement training applications. These systems are very complex and are typically too expensive for the average shooter to afford. The expense of these systems can even be cost prohibitive for military and law enforcement departments. Additionally, these systems are often large and limited in portability.

There is a need for a system that is affordable, portable, and that delivers feedback to the shooter. The previous training systems lack the ability to provide feedback in a manner that offers both minimal set up expenses and sustainable ongoing expenses. Further, there is a need for such a system that is adaptable to a plurality of different firearm platforms (e.g., real firearms, replica firearms, inert training aids, or other similar devices).

Affordable and portable firearm training devices are described herein. In some embodiments, a firearm training device comprises a firearm frame including a barrel having a camera disposed at a distal end. The firearm frame further includes a grip attached to the barrel and a trigger in proximity to the grip. In embodiments, the trigger can be configured to toggle an electronic switch. The firearm frame can also include a controller communicatively coupled to the camera and the electronic switch. The controller is configured to collect an image frame, via the camera, when the electronic switch is toggled, and generate a composite image including the image frame and a strike indicator overlaid onto the image frame, whereby the composite image demonstrates where a firearm strike would have occurred. In other embodiments, the firearm training device comprises an attachment for a firearm (e.g., a live firearm or a training/mock firearm). For example, the firearm training device can be used to employ a live firearm as a training firearm by providing user feedback of where firearm strikes would have occurred without a need for bullets. In another example, the firearm training device can be used as an attachment for a training/mock firearm that provides visual feedback in the form of illumination directed at the site where a firearm strike would have occurred. In such uses, the firearm training device can add functionality to the training/mock firearm.

Example Implementations

FIGS. 1 through 6B illustrate firearm training devices in accordance with embodiments of the present disclosure. The firearm training devices are configured to capture images of simulated shot impact locations (i.e., where a firearm strike would have occurred if a live firearm were employed).

As shown in FIG. 1, a firearm training device 100 may include a firearm frame 102. In some embodiments, the firearm frame 102 can emulate the functional and/or aesthetic elements of a live firearm (e.g., handgun). For example, the firearm training device 100 includes barrel 104 attached to a grip 106. As used herein, the "barrel 104" generally refers to a casing that is supported by (e.g., attached to) the grip 106. For example, the barrel 104 can be configured as shown in FIG. 1, where the barrel 104 and the grip 106 are arranged in an L or V shaped configuration. The barrel 104 may hold or support an action, a slide, and/or a muzzle. In some embodiments, the grip 106 can include an interior cavity in which a live-fire and/or training magazine 108 can be inserted for training magazine changes. The firearm training device 100 can also include a front sight 110 and/or a rear sight 112 disposed on the barrel 104. In some embodiments, the firearm training device 100 can also include a slide, which can comprise a rackable slide or a static slide. The firearm training device can also include a realistic trigger 114. In embodiments, the trigger 114 is disposed in close proximity to the grip 106. While a handgun is illustrated in FIGS. 1 and 2A, the firearm training device 100 can comprise any type of firearm such as a revolver, a rifle, a shotgun, or the like.

Figure 2A:
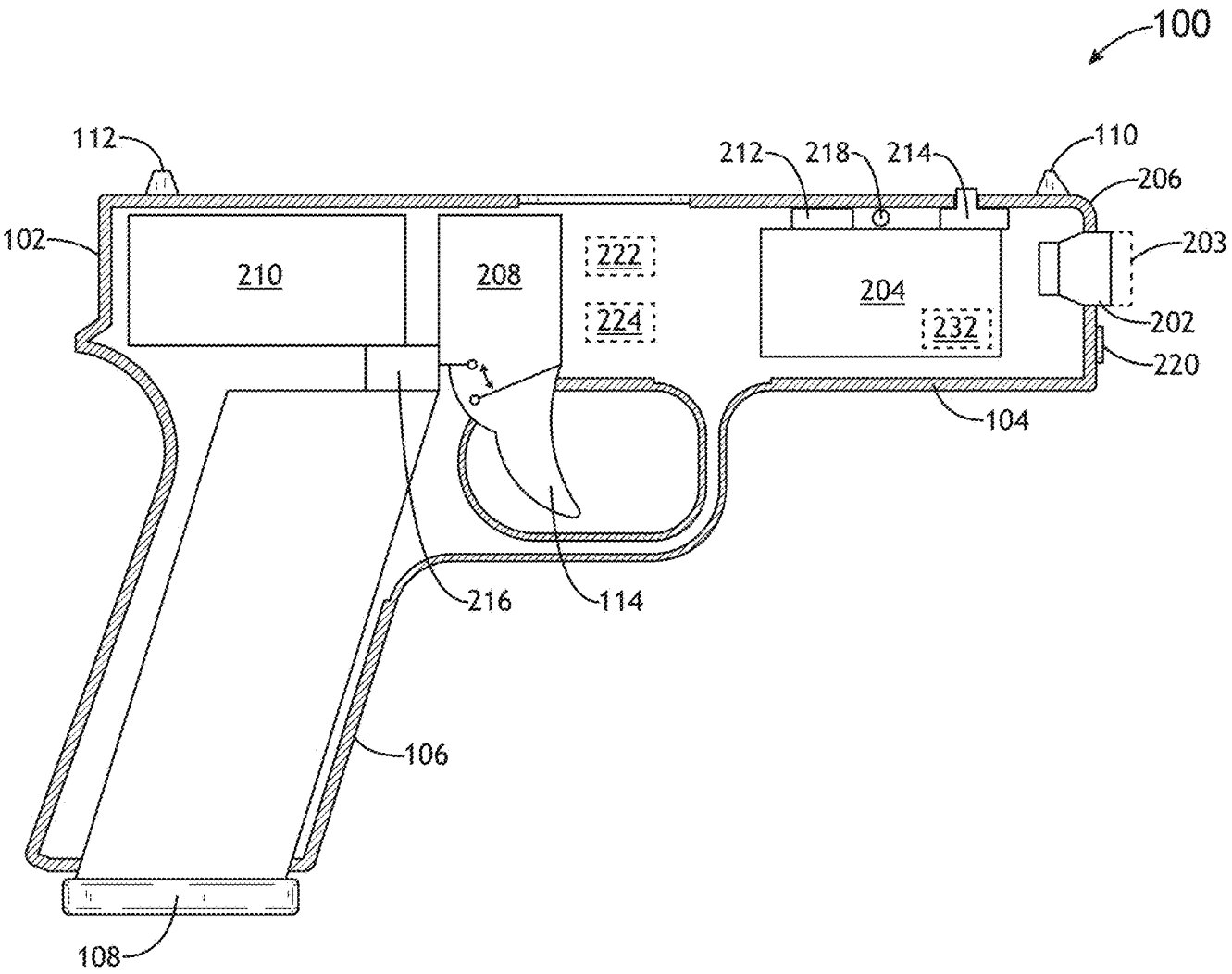
FIG. 2A is a diagrammatic side view of a firearm training device, in accordance with an embodiment of the present disclosure.
Figure 2B:
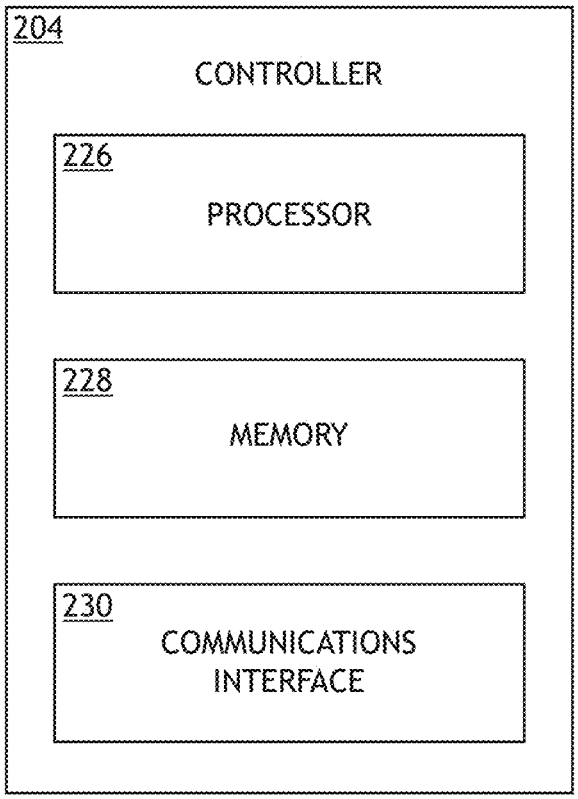
FIG. 2B is a block diagram illustrating a controller of a firearm training device in accordance with an embodiment of the present disclosure.
Figure 2C:
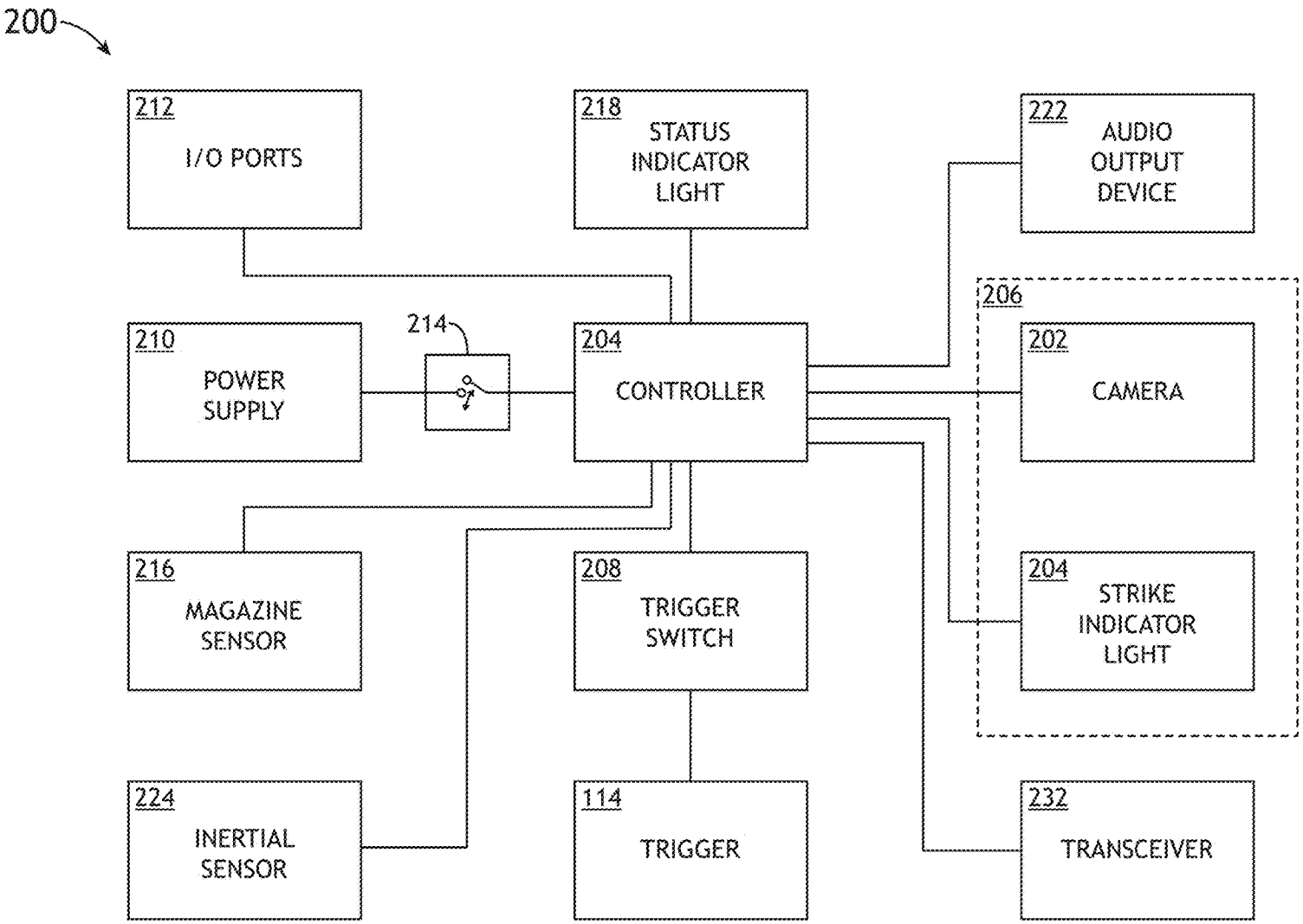
FIG. 2C is a block diagram illustrating an electronic system of a firearm training device, in accordance with an embodiment of the present disclosure.

Referring now to FIGS. 2A through 2C, the firearm training device 100 includes one or more image capture devices (e.g., one or more cameras 202 or other photodetectors or photodetector arrays) coupled with a controller 204. The camera 202 is configured to capture and process images within its filed-of-view (FOV). In some embodiments, the camera 202 is disposed near the distal end of the barrel 104. For example, the camera 202 can be positioned near the muzzle area 206 of the firearm training device 100 (e.g., the approximate location where a bullet would exit if the training firearm were a live firearm), aligning the muzzle with the FOV of the camera 202. When the camera 202 is reasonably aligned with the muzzle area 206 of the firearm training device 100, the camera 202 can capture images of the area where a firearm strike would occur. However, it is contemplated that the camera 202 may be positioned elsewhere on the training firearm (e.g., above the barrel 104, beneath the magazine 108, near the front sight 110, etc.).

In some embodiments, the firearm training device 100 includes a zoom lens 203 that is part of the camera 202 and/or disposed adjacent to the camera 202 so that the image frames and/or video segments collected by the camera 202 are magnified. The zoom lens 203 may be further configured to control the FOV of the camera 202. For example, the zoom lens 203 may have a narrow FOV. In some embodiments, the zoom lens 203 has a fixed focal length in the range of 4 to 16 millimeters (e.g., 8 mm). In other embodiments, the zoom lens 203 may be an adjustable zoom lens.

The camera 202 is configured to capture image frame data representing an environmental view within the FOV of the camera 202. For example, the camera 202 may capture image data representing objects at which the firearm training device 100 was aimed. In some embodiments, the camera is configured to capture still image frames within the FOV of the camera 202. In other embodiments, the camera 202 can capture two-dimensional and/or three-dimensional video imagery. Those skilled in the art will appreciate that although the singular tense, "camera," is often used herein, the camera 202 can comprise a plurality of cameras or optical sensors without departing from the scope of this disclosure. For example, the camera 202 may include a stereoscopic camera that comprises two or more cameras, photodetectors or photodetector arrays.

The controller 204 is configured to receive and store image data from the camera 202. As shown in FIG. 2C, the controller 204 can be the central processing component in an electronic system 200 that is built into the firearm training device 100 (e.g., as shown in FIG. 2A). In an embodiment shown in FIG. 2B, the controller 204 includes a processor 226, a memory 228, and a communications interface 230.

The processor 226 provides processing functionality for at least the controller 204 and can include any number of processors, micro-controllers, circuitry, field programmable gate array (FPGA) or other processing systems, and resident or external memory for storing data, executable code, and other information accessed or generated by the controller 204. The processor 226 can execute one or more software programs embodied in a non-transitory computer readable medium (e.g., memory 228) that implement techniques described herein. The processor 226 is not limited by the materials from which it is formed or the processing mechanisms employed therein and, as such, can be implemented via semiconductor(s) and/or transistors (e.g., using electronic integrated circuit (IC) components), and so forth.

The memory 228 can be an example of tangible, computer-readable storage medium that provides storage functionality to store various data and or program code associated with operation of the controller 204, such as software programs and/or code segments, or other data to instruct the processor 226, and possibly other components of the electronic system 200/controller 204, to perform the functionality described herein. Thus, the memory 228 can store data, such as a program of instructions for operating the firearm training device 100 (including its components), and so forth. It should be noted that while a single memory 228 is described, a wide variety of types and combinations of memory (e.g., tangible, non-transitory memory) can be employed. The memory 228 can be integral with the processor 226, can comprise stand-alone memory, or can be a combination of both. Some examples of the memory 228 can include removable and non-removable memory components, such as random-access memory (RAM), read-only memory (ROM), flash memory (e.g., a secure digital (SD) memory card, a mini-SD memory card, and/or a micro-SD memory card), magnetic memory, optical memory, universal serial bus (USB) memory devices, hard disk memory, external memory, and so forth. In implementations, the firearm training device 100 and/or the memory 228 can include removable integrated circuit card (ICC) memory, such as memory provided by a subscriber identity module (SIM) card, a universal subscriber identity module (USIM) card, a universal integrated circuit card (UICC), and so on.

The communications interface 230 can be operatively configured to communicate with components of the electronic system 200. For example, the communications interface 230 can be configured to retrieve image data from the camera 202, transmit data for storage in the memory 228, retrieve data from storage in the memory 228, and so forth. The communications interface 230 can also be communicatively coupled with the processor 226 to facilitate data transfer between components of the electronic system 200 and the processor 226 (e.g., for communicating inputs to the processor 226 received from a device (e.g., mobile device 302) communicatively coupled with the electronic system 200/controller 204). It should be noted that while the communications interface 230 is described as a component of controller 204, one or more components of the communications interface 230 can be implemented as external components communicatively coupled to the firearm training device 100/electronic system 200 via a wired and/or wireless connection. The firearm training device 100 can also include and/or connect to one or more input/output (I/O) devices (e.g., via the communications interface 230), such as a display, a mouse, a touchpad, a touchscreen, a keyboard, a microphone (e.g., for voice commands) and so on. For example, the communications interface 230 can include or can be coupled to a transceiver 232 (e.g., wireless transceiver) and/or one or more I/O ports 212 (e.g., USB, micro-USB, USB-C port or the like).

The controller 204 can be communicatively coupled to the camera 202 and/or other components of the electronic system 200/firearm training device 100 via a wired or wireless network. The electronic system 200/firearm training device 100 can include a variety of communication components and functionality, including, but not limited to: one or more antennas; a browser; a transceiver (e.g., wireless transceiver); and/or receiver; a wireless radio; data ports; software interfaces and drivers; networking interfaces; data processing components; and so forth. In some embodiments, the communication components are integral to the controller 204.

The network may assume a wide variety of configurations. For example, the network may comprise any of a plurality of communications standards, protocols and technologies, including, but not limited to: a 3G communications network, a 4G communications network, a Global System for Mobile Communications (GSM) environment, an Enhanced Data GSM Environment (EDGE) network, a high-speed downlink packet access (HSDPA) network, a wideband code division multiple access (W-CDMA) network, a code division multiple access (CDMA) network, a time division multiple access (TDMA) network, Bluetooth, Wireless Fidelity (Wi-Fi) (e.g., IEEE 802.11a, IEEE 802.11b, IEEE 802.11 g and/or IEEE 802.11n), voice over Internet Protocol (VoIP), Wi-MAX, a protocol for email (e.g., Internet message access protocol (IMAP) and/or post office protocol (POP)) environment, an instant messaging (e.g., extensible messaging and presence protocol (XMPP) environment, Session Initiation Protocol for Instant Messaging and Presence Leveraging Extensions (SIMPLE), and/or Instant Messaging and Presence Service (IMPS), and/or Short Message Service (SMS)), or any other suitable communication protocol, that facilitates communication between the electronic system 200, the mobile electronic device 302, and/or any of their components.

In embodiments, the controller 204 is configured to collect an image frame, via the camera 202, based on a trigger pull event. The controller 204 and/or the camera 202 can be communicatively coupled with the trigger 114. For example, as shown in FIGS. 2A and 2C, the trigger 114 can be electrically, mechanically, electromechanically, and/or magnetically coupled to an electronic switch 208 (sometimes referred to as the "trigger switch 208"). The electronic switch 208 can be disposed inside the firearm training device 100 and can be positioned in a manner that allows the electronic switch 208 to be responsive to movement of the trigger mechanisms when the trigger 114 is squeezed/pulled. For example, the trigger 114 can be configured to toggle the electronic switch 208 when the trigger is squeezed/pulled. For example, the electronic switch 208 can be toggled (e.g., switched) from a first state (on/off, logic 1 or logic 0) to a second state (e.g., off/on, logic 0 or logic 1). The electronic switch 208 transmits its status to controller 204 and causes the processor 226 to activate the camera 202. In some embodiments, the controller 204 can include circuitry (e.g., a de-bouncing circuit) for interacting with the electronic switch 208. In other embodiments, the camera 202 and/or the controller 204 can communicate with the electronic switch 208 and/or trigger 114 via the wired or wireless network. When the electronic switch 208 is toggled, the controller 204 is configured to collect an image frame and/or video recording via the camera 202. For example, the processor 226 can activate the camera 202, causing the camera 202 to capture an image or video recording of the location at which the muzzle area 206 of the firearm training device 100 was aimed.

The controller 204 can be configured to generate an image indicating where a firearm strike would have occurred. For example, with reference to FIG. 3A, the processor 226 can be configured to generate a composite image 311 including the image frame 312 and a strike indicator 314 overlaid onto the image frame 312, the strike indicator 314 demonstrating where a firearm strike would have occurred within the composite image 311. The processor can associate each composite image 311 with a unique file identifier and/or a time stamp. Each composite image 311 and its associated file identifier and/or time stamp may be stored in memory (e.g., memory 228). In embodiments, the processor 226 can also associate each image frame 312 with a file identifier and/or time stamp.

In some embodiments, the controller 204 is configured to adjust the composite image 311 based on motion of the firearm training device 100. For example, the controller 204 can include or can be coupled to one or more inertial sensors 224 configured to measure motion (e.g., vibration) of the firearm training device 100 (e.g., as described with reference to FIG. 3). In embodiments, the inertial sensors 224 can comprise one or more accelerometers, gyroscopes, and/or microphones. The inertial sensors can measure data about the motion of the firearm training device 100 prior to and during a trigger pull event. The controller 204 can also include an analog-to-digital converter (ADC) configured to convert analog data received from the inertial sensors 224 to digital data that is readable by the processor 226. The controller 204 can analyze data received from the inertial sensors 224 to predict errors in the simulated firearm strike due to motion of the firearm training device 100. For example, the processor can adjust the strike indicator 314 to account for motion of the firearm training device 100. In some embodiments, the wherein the controller 204 is further configured to determine a firing time based upon a time difference between receiving a signal from the inertial sensor 224 (e.g., accelerometer) indicating drawing of the firearm training device and the time stamp associated with the composite image 311 or video collected/generated in response to the trigger pull event (e.g., the time stamp associated with image frame 312).

The camera 202 and/or controller 204 can be coupled with a power supply 210. In embodiments, the power supply 210 can comprise a rechargeable and/or interchangeable battery. The firearm training device 100 can also include one or more I/O ports 212 (e.g., Universal Serial Bus (USB) configured for charging the power supply 210, providing a secondary power source, and/or facilitating data transfer). In some embodiments, the firearm training device 100 includes a power switch 214 for controlling power to firearm training device 100. In some embodiments, power to the firearm training device 100 can be controlled by detecting the presence of the magazine 108. For example, the power supply 210 can be coupled with a sensor 216 configured to detect the presence of the magazine 108.

The firearm training device 100 can also include an indicator 218 (e.g., LED indicator) configured to indicate the power status of the firearm training device 100. In some embodiments, the firearm training device can also include strike indicator light 220 (e.g., laser) for providing visual feedback to the user by illuminating a location where a firearm strike would have occurred if a live (and loaded) firearm were being used.

Figure 3A:
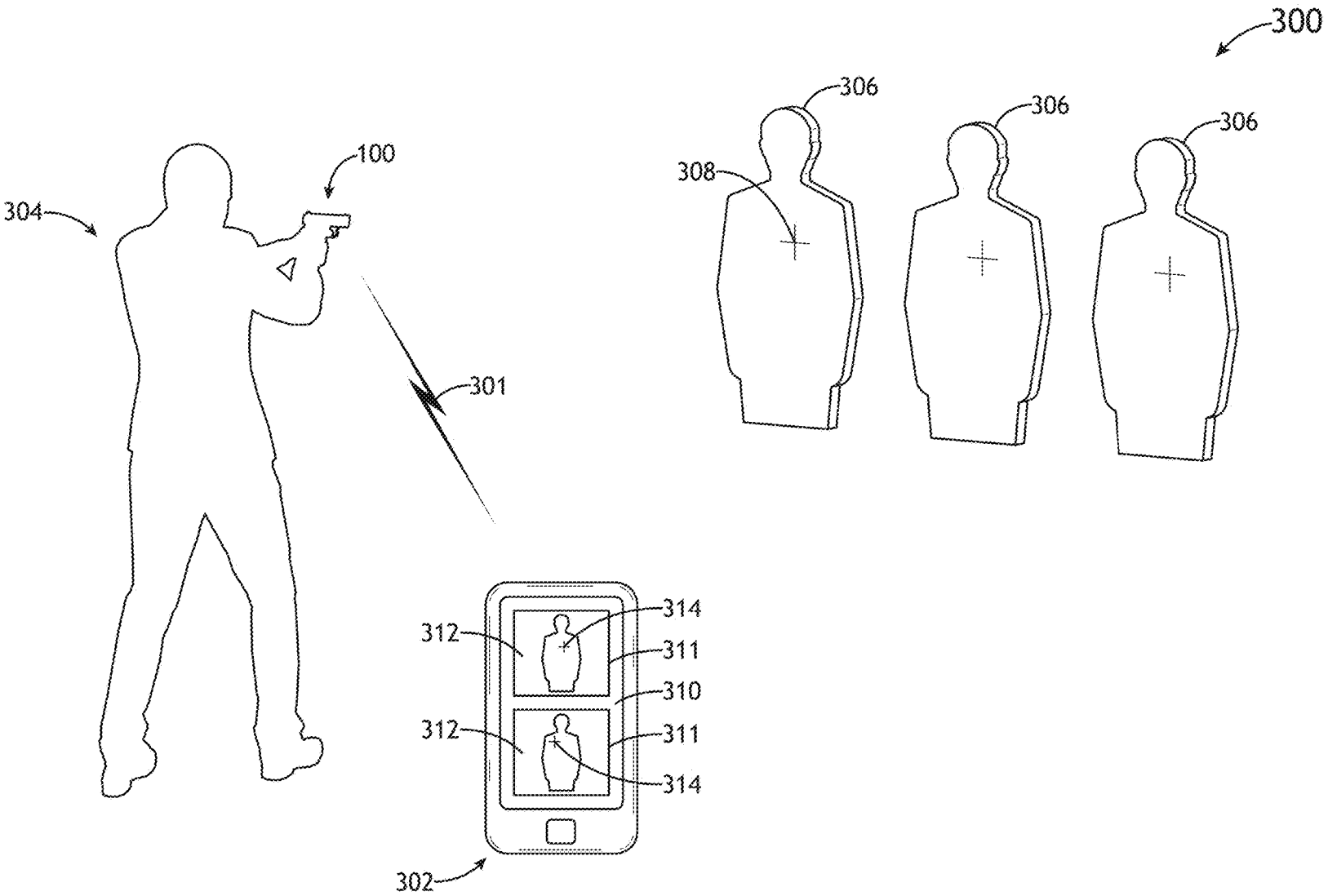
FIG. 3A illustrates a firearm training system that employs a firearm training device, in accordance with an embodiment of the present disclosure.

FIG. 3A illustrates an implementation of a firearm training system 300 that employs the firearm training device 100 and a mobile device 302 communicatively coupled to the firearm training device 100. In embodiments, the firearm training device 100 can furnish data (e.g., image frames, composite images, video segments, composite video segments, etc.) to one or more computing devices (e.g., mobile device 302). While a mobile device 302 is shown in FIG. 3, the computing device can include any one of a variety of processing devices. For example, the computing device may be a server computing device, a desktop computing device, a laptop computing device, and so forth. The firearm training device 100 can furnish data to the mobile device 302 via the wired or wireless communication network, as described above. For example, the controller 204 can include or can be coupled to a wireless transceiver 232 configured to transmit the data to the mobile device 302.

Figure 3B:
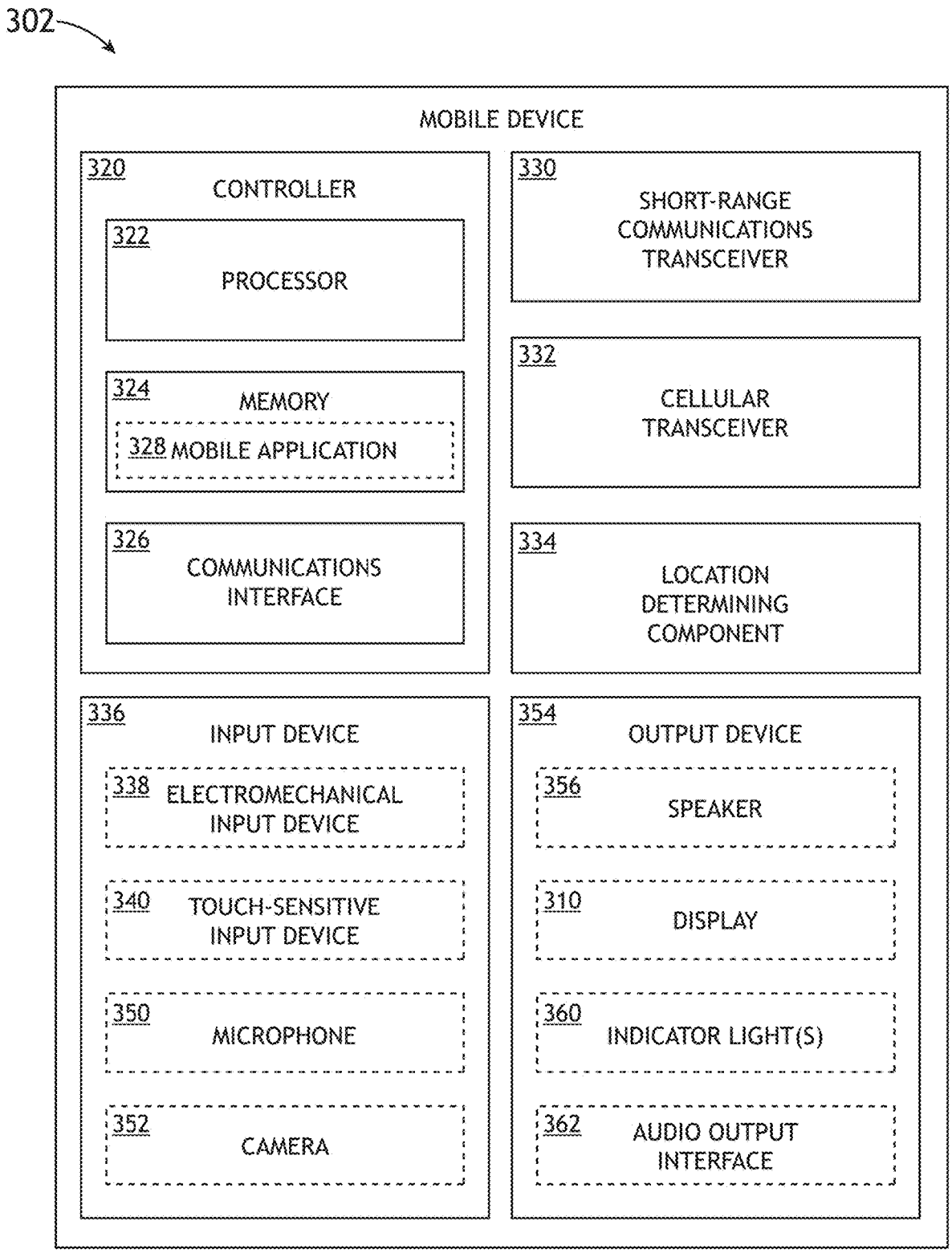
FIG. 3B is a block diagram illustrating a mobile device that can be configured to communicate with a firearm training device to implement a firearm training system, in accordance with an embodiment of the present disclosure.

An embodiment of the mobile device 302 is shown in FIG. 3B. The mobile device 302 may be a smartphone, media player, tablet, smartwatch, or the like. In embodiments, the mobile device 302 includes a controller 320 communicatively coupled to one or more input devices 336 and one or more output devices 354. In embodiments, an input device 336 can include, but is not limited to, an electromechanical input device 338 (e.g., one or more buttons, keypad, switches, or toggles), a touch-sensitive input device 340 (e.g., a touch pad, touch panel, or the like), a microphone 350, and/or a camera 352. In embodiments, an output device 354 can include, but is not limited to, a speaker 356, a display 310, one or more indicator lights 360, and/or an audio output interface 362 (e.g., a line out audio port or connector). The mobile device 302 can include a short-range communications transceiver 330 (e.g., a Bluetooth transceiver, near field communications (NFC) transceiver, WiFi transceiver, or the like). For example, as described herein, the mobile device 302 can be configured to communicate with the firearm training device 100/electronic system 200 via the short-range communications transceiver 330. The mobile device 302 can also include a cellular transceiver 332 (e.g., 2G, 3G, 4G, and/or LTE transceiver or the like) for sending and receiving mobile data and handling calls. In embodiments, the mobile device 302 further includes a location determining component 334, such as, but not limited to, a Global Navigation Satellite System (GNSS) receiver (e.g., GPS receiver, GLONASS receiver, Galileo receiver, Beidou receiver, multi-protocol receiver, software defined GNSS receiver, or a combination thereof, or the like. For example, the mobile device 302 can be configured to determine a current location, which may be associated with the image frames/video collected by the firearm training device 100/electronic system 200.

The controller 320 is communicatively coupled with some or all of the components of the mobile device 302. For example, the controller 320 can be communicatively coupled with the input device(s) 336, the output device(s) 354, short-range communications transceiver 330, cellular transceiver 332, and any sensors or other components (e.g., location determining component 334) of the mobile device 302. The controller 320 has a processor 322 included with or in the controller 320 to control the components and functions of the mobile device 302 described herein using software, firmware, hardware (e.g., fixed logic circuitry), or a combination thereof. The terms "controller," "functionality," "service," and "logic" as used herein generally represent software, firmware, hardware, or a combination of software, firmware, or hardware in conjunction with controlling the mobile device 302. As shown in FIG. 3B, the controller 320 can include a processor 322, a memory 324, and a communications interface 326.

The processor 322 provides processing functionality for at least the controller 320 and can include any number of processors, micro-controllers, circuitry, field programmable gate array (FPGA) or other processing systems, and resident or external memory for storing data, executable code, and other information accessed or generated by the controller 320. The processor 322 can execute one or more software programs (e.g., mobile application 328) embodied in a non-transitory computer readable medium (e.g., memory 324) that implement techniques described herein. The processor 322 is not limited by the materials from which it is formed or the processing mechanisms employed therein and, as such, can be implemented via semiconductor(s) and/or transistors (e.g., using electronic integrated circuit (IC) components), and so forth.

The memory 324 can be a tangible, computer-readable storage medium that provides storage functionality to store various data and or program code associated with operation of the controller 320, such as software programs (e.g., mobile application 328 or "App") and/or code segments, or other data to instruct the processor 322, and possibly other components of the mobile device 302/controller 320, to perform the functionality described herein. The memory 324 can store data, such as a program of instructions for operating the mobile device 302 (including its components), and so forth. It should be noted that while a single memory 324 is described, a wide variety of types and combinations of memory (e.g., tangible, non-transitory memory) can be employed. The memory 324 can be integral with the processor 322, can comprise stand-alone memory, or can be a combination of both. Some examples of the memory 324 can include removable and non-removable memory components, such as random-access memory (RAM), read-only memory (ROM), flash memory (e.g., a secure digital (SD) memory card, a mini-SD memory card, and/or a micro-SD memory card), magnetic memory, optical memory, universal serial bus (USB) memory devices, hard disk memory, external memory, and so forth. In embodiments, the mobile device 302 and/or the memory 324 can include removable integrated circuit card (ICC) memory, such as memory provided by a subscriber identity module (SIM) card, a universal subscriber identity module (USIM) card, a universal integrated circuit card (UICC), and so on.

The communications interface 326 can be operatively configured to communicate with components of the mobile device 302. For example, the communications interface 326 can be configured to transmit data for storage in the mobile device 302, retrieve data from storage in the mobile device 302, and so forth. The communications interface 326 can also be communicatively coupled with the processor 322 to facilitate data transfer between components of the mobile device 302 and the processor 322 (e.g., for communicating inputs to the processor 322 received from a device communicatively coupled with the controller 320, including, but not limited to, data received from the location determining component 224, any input device 226, and/or any other component of the mobile device 302). It should be noted that while the communications interface 326 is described as a component of controller 320, one or more components of the communications interface 326 can be implemented as components of the mobile device 302 or components communicatively coupled to the mobile device 302 via a wired and/or wireless connection. For example, the mobile device 302 and/or the controller 320 includes the short-range communications transceiver 330 (or in some embodiments, a transmitter and a receiver) for sending and receiving communications to and from the firearm training device 100/electronic system 200.

In embodiments, the display 310 is a touch-sensitive display configured for conveying information to a user of the mobile device 302. The display 310 can include a LED (light emitting diode) display, a LCD (Liquid Crystal Diode) display, a TFT (Thin Film Transistor) LCD display, a LEP (Light Emitting Polymer), PLED (Polymer Light Emitting Diode) display, or the like, configured to display text and/or graphical information such as a graphical user interface. In some embodiments, the touch-sensitive display may include a touch panel. The touch panel may be, but is not limited to: a capacitive touch panel, a resistive touch panel, an infrared touch panel, combinations thereof, and the like. Thus, the display 310 may be configured to receive input from a user and display information to the user of the mobile device 302. For example, the display 310 displays visual output to the user. The visual output may include graphics, text, icons, video, interactive fields configured to receive input from a user, and any combination thereof (collectively termed "graphics"). In some embodiments, some or all of the visual output may correspond to user-interface objects, further details of which are described below.

The display 310 is communicatively coupled to a display controller that is configured to receive and/or transmit electrical signals to the touch-sensitive display 310. In an implementation, the touch panel includes a sensor, an array of sensors, or the like, configured to accept input from a user based upon haptic and/or tactile contact. The touch panel, in combination with the display controller (along with any associated modules and/or sets of computer-readable instructions in memory), detects a point of contact (or points of contact), as well as any movement or breaking of the contact, on the touch panel and converts the detected contact (e.g., a finger of the user, a stylus, etc.) into electrical signals representing interactions with user-interface objects (e.g., buttons, custom views, icons, web pages, images, web page links, etc.) that are displayed through the display 310.

The mobile device 302 can include a user interface, which is storable in memory 328 and executable by the processor 322. The user interface is representative of functionality to control the display of information and data to the user of the mobile device 302 via the display 310. In some implementations, the display 310 may not be integrated into the mobile device 302 and may instead be connected externally using universal serial bus (USB), Ethernet, serial connections, and so forth. The user interface may provide functionality to allow the user to interact with one or more applications of the mobile device 302 by providing inputs via the touch panel and/or the I/O devices. For example, the user interface may cause an application programming interface (API) to be generated to furnish functionality to an application to configure the application for display by the display 310 or in combination with another display. In embodiments, the API may further furnish functionality to configure the application to allow the user to interact with an application by providing inputs via the touch panel and/or the I/O devices.

Applications (e.g., mobile application 328) may comprise software, which is storable in memory 324 and executable by the processor 322, to perform a specific operation or group of operations to furnish specified functionality to the mobile device 302. Example applications may include content resource management applications, cellular telephone applications, instant messaging applications, email applications, address book applications, and so forth.

As illustrated in FIG. 3A, the firearm training device 100 can communicate with the mobile device 302 to provide feedback to a user 304 about a simulated firearm strike. For example, the firearm training device 100 and the mobile device 302 can communicate over a wired or wireless communication channel 301 (e.g., via transceiver 232 and transceiver 330, or a wired connection). In implementations, the user 304 can aim the firearm training device 100 at a target 306 and engage in a trigger pull event (e.g., shoot the firearm training device 100). The target 306 can comprise any type of shooting target or object including, but not necessarily limited to: paper/cardboard target, steel target, rubber target, frangible target, bullseye, silhouette target, pop-up target, aerial target, reactive target, explosive target, field target, and so forth. The target 306 can comprise any size or shape.

Based on the trigger pull event, the firearm training device 100 can furnish image data (e.g., composite image 311) to the mobile device 302. For example, when the trigger 114 is squeezed/pulled (e.g., when electronic switch 208 is toggled), the controller 204 can collect an image frame 312 of the target 306 from the camera 202. The controller can activate the camera 202, causing the camera 202 to capture an image in real time of the target 306 at which the muzzle area 206 of the firearm training device 100 was aimed, as described above.

The firearm training device 100 can generate an image indicating where a firearm strike would have occurred. For example, the processor can generate a composite image 311 including the image frame 312 of the target and a strike indicator 314 overlaid onto the image frame, the strike indicator 314 demonstrating where a firearm strike would have occurred within the composite image 311. The strike indicator 314 on the composite image 311 corresponds with the location 308 on the target 306 at which the firearm was aimed when the trigger event occurred. The controller 204 can associate each composite image 311 with a unique file identifier and/or a time stamp. Each composite image 311 and its associated file identifier and/or time stamp are storable in memory. The firearm training device 100 can transmit, via the wireless transceiver 232, the file identifier and/or time stamp to the mobile device 302.

The mobile device 302 can request the composite images 311 from the firearm training device 100 based on the file identifier and/or time stamp. In some implementations, the mobile device 302 can request the composite image 311 automatically (e.g., based on connection to the firearm training device 100). In other implementations, the mobile device 302 can request the composite image 311 based on user input. After receiving a request from the mobile device 302 including the file identifier and/or time stamp, the firearm training device 100 transmits the corresponding composite image 311 to the mobile device 302 via the wireless transceiver.

In other embodiments, the firearm training device 100 can transmit image frames to the mobile device 100. For example, the controller 204 can associate each image frame with a unique file identifier and/or a time stamp. The firearm training device 100 can transmit, via the wireless transceiver, the image frames to the mobile device 302 upon receiving a request including the file identifier and/or time stamp. The mobile device 302 can then generate the composite image 311.

In embodiments, the mobile device 302 utilizes the image frames 312 and/or composite images 311 to generate feedback for the user 304. For example, the mobile device 302 can present one or more composite images 311 to the user 304 via the display 310. The composite images 311 include the strike indicator 314 to provide the user feedback about the accuracy of the shot. For example, the strike indicator 314 corresponds to the location 308 on the target 306 at which a firearm strike occurred based on the position (e.g., aim) of the firearm training device 100.

In some implementations, the controller 204 can be configured to calibrate the strike indicator 314 (e.g., as described with reference to FIGS. 4A through 4C). For example, the controller 204 can reposition the strike indicator 314 to a user-defined position 315 based on one or more test image frames. The calibration techniques described herein can be utilized to align the strike indicator 314 with the axis of bore (e.g., the axis which passes through the center of the barrel) of the firearm training device 100.

Figure 4A:
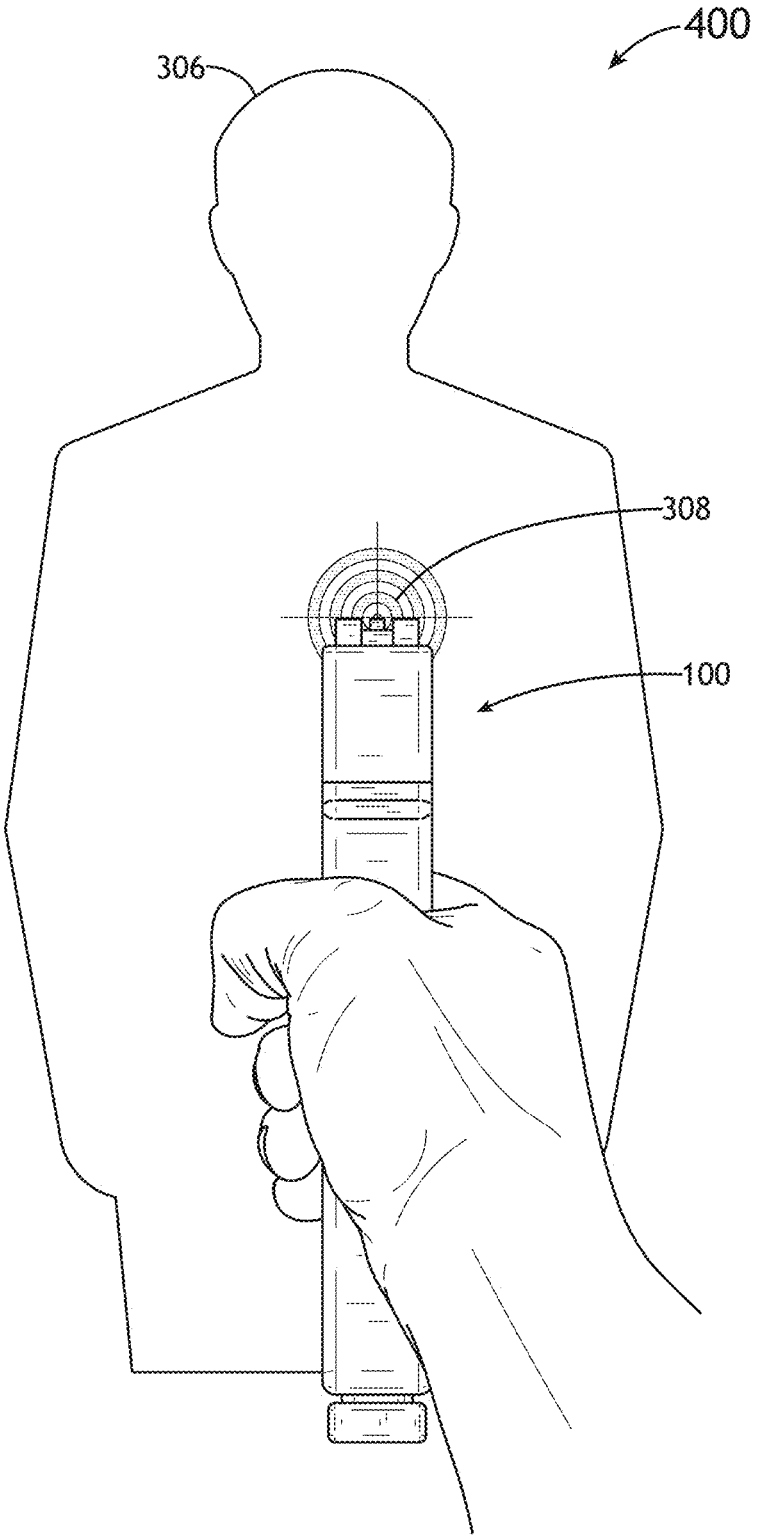
FIG. 4A illustrates an example environment for calibrating a firearm training device.
Figure 4B:
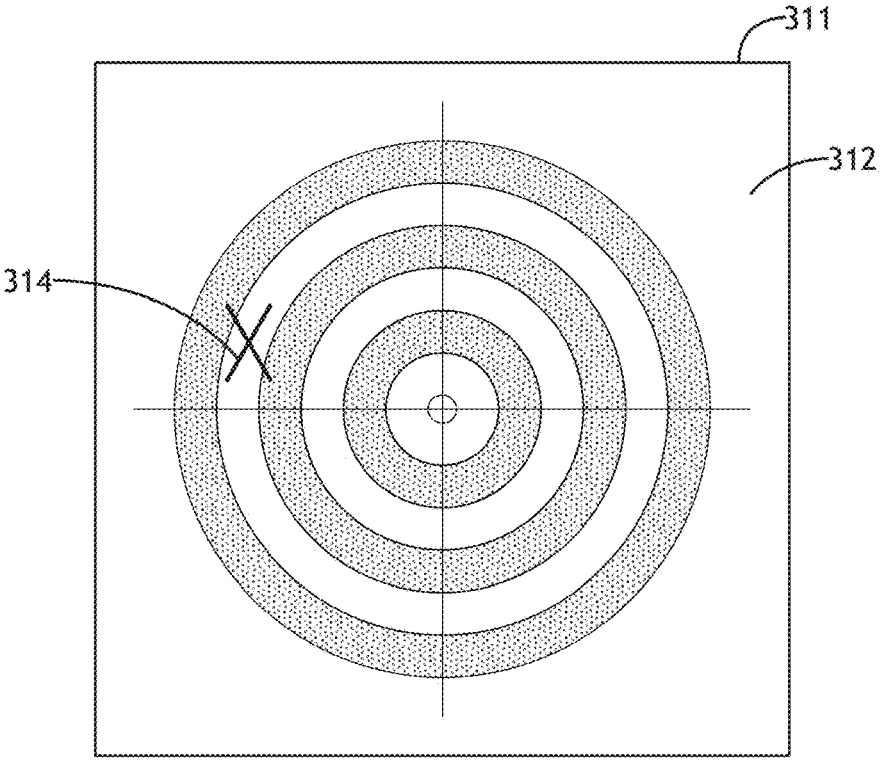
FIG. 4B illustrates an example display output for calibrating a firearm training device, wherein the display output includes a composite image of an image collected by the firearm training device and a strike indicator overlaid onto the image collected by the firearm training device to indicate where a firearm strike would have occurred.
Figure 4C:
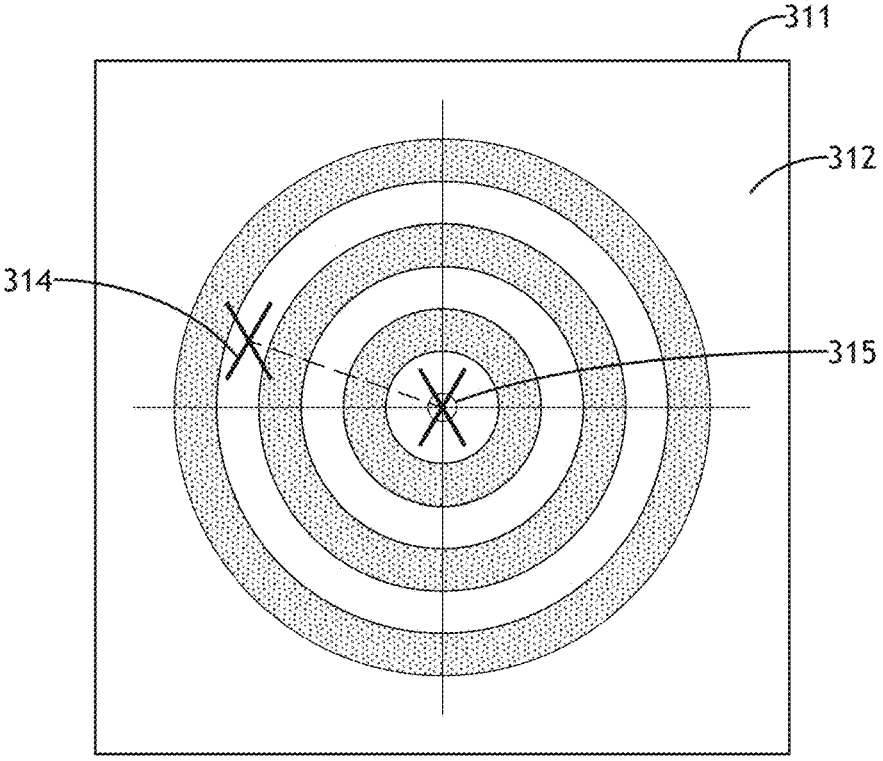
FIG. 4C illustrates an example display output for calibrating a firearm training device, wherein the display output includes a composite image of an image collected by the firearm training device and a strike indicator overlaid onto the image collected by the firearm training device to indicate where a firearm strike would have occurred, and the display is configured to receive one or more user inputs, whereby a user repositions the strike indicator to a user-defined position associated with sights on the firearm frame.

FIG. 4A illustrates an environment 400 in an example implementation that is operable to facilitate the calibration of a firearm training device 100 in accordance with the present disclosure. The user 304 aims (e.g., aligns the axis of bore of the firearm training device 100) at a specific location 308 based on the sights 110, 112 of the firearm frame 102. For example, the user 304 aims the firearm training device 100 at a specific location 308 on a close-range target 306. The user 304 then fires the firearm training device 100 (i.e., causes a trigger pull event).

Based on the trigger pull event, the firearm training device 100 collects an image frame 312 from the camera 202. For example, when the electronic trigger switch 208 is toggled, the controller 204 collects a first image frame 312 of the target 306 via the camera 202. The controller 204 is configured to generate a first composite image 311 including the first image frame 312 and a first strike indicator 314 overlaid on the first image frame 312 (e.g., as described with reference to FIG. 4B). The first strike indicator 314 may or may not accurately indicate the location 308 at which the firearm training device 100 was aimed. The controller 204 is configured to transmit (e.g., via wireless transceiver 232) the first composite image 311 including the first image frame 312 and the first strike indicator 314 to the mobile device 302. Then, as shown in FIG. 4C, the mobile device 302 is configured to generate new coordinates for the first strike indicator 314 corresponding to a user-defined position 315 based on user input. For example, the user 304 can, via the touch-sensitive display 310, move the first strike indicator 314 to a location on the image frame 312 corresponding to the user-defined position 315. The processor 322 of the mobile device 302 can be configured to determine/generate coordinates of the adjusted strike indicator 314.

The controller 204 is configured to receive the coordinates from the mobile device 302. In some embodiments the controller 204 may generate one or more additional composite images 311 for calibrating the firearm training device 100. For example, the controller 204 may generate a second composite image 311 including a second strike indicator 314 based on a second test image frame 312. Generating additional composite images can enhance the accuracy of calibration. After the firearm training device 100 is calibrated, the controller 204 is configured to overlay a strike indicator 314 on a subsequent image frame 312 collected by the camera 202 (e.g., in response to a trigger pull event occurring after calibration) based on the coordinates received from the mobile device 302. It is to be understood that this calibration process is offered by way of example only and is not meant to be restrictive of the present disclosure. Other manual or automated calibration processes may be used. For example, the user 304 may calibrate the firearm training device 100 by manually adjusting one or more of its components (e.g., the sights 110, 112).

In embodiments, the mobile device 302 may include a shot timer. For example, the mobile device 302 can include a sound sensor or microphone configured to record each shot of the firearm training device 100. Alternatively, as previously described herein, the controller 204 of the firearm training device 100/electronic system 200 can be configured to calculate the shot/reaction time and send it to the mobile device 302. The processor 322 of the mobile device 302 can be configured to sync the time of each shot with the time stamps received from the controller 204. The mobile device 302 can then generate of a report of shot times for the user 304 via the display 310. In some embodiments, the controller 204 is configured to receive (e.g., via transceiver 232) a signal from the mobile device 302 indicating a start time. The controller 204 may be configured to determine (e.g., calculate) a reaction time by subtracting the start time from the time stamp associated with the image frame 312. In some implementations, the mobile device 302 is also configured to provide an audio output (e.g., alert/alarm) indicating that the user is to start firing. In such implementations, at the same, substantially same time, or just prior to providing the audio output, the mobile device 302 can be configured to transmit the signal to the controller 204 so that the start time is stored by the controller 204 and used to determine the reaction time. In some embodiments, the firearm training device 100/electronic system 200 itself includes an audio output device 222 (e.g., piezo buzzer or other buzzer/loudspeaker device) that is configured to generate the audio output when the controller 204 receives the signal from the mobile device 302. In such embodiments, the controller 204 can be configured to generate the start time and the time stamp, allowing for a more accurate reaction time to be determined by the controller 204 because transmission delay and/or synchronization issues can be avoided/minimized. The controller 204 can be configured to transmit the reaction time to the mobile device 302.

The firearm training device 100 and/or the mobile device 302 can be figured to provide image recognition feedback. For example, the controller 204 and/or mobile device can utilize one or more processors to determine if the firearm strike constituted a "hit" or a "miss" based on the composite image 311. In some embodiments, target 306 can include one or more impact sensors configured to communicate data to the controller 204 and/or mobile device 302. The controller 204 and/or the mobile device 302 can utilize the impact data to determine whether the firearm strike constituted a "hit" or a "miss".

In some embodiments, the firearm training device 100 can be configured to provide video segments (e.g., a plurality of image frames 312) to the mobile device 302. For example, the camera 202 can be configured to capture two-dimensional and/or three-dimensional video imagery. The video segments can then be displayed to the user via the display 310 of the mobile device 302. Alternatively, the mobile device 302 can be configured to capture video segments associated with each shot of the firearm training device 100. The video segments can then be synchronized with the composite images 311 based on the time stamps. The video segments can provide the user 304 with feedback of the events that occurred before and after the trigger pull event.

The firearm training device 100 and/or the mobile device 302 may be configured to communicate with other devices. For example, devices in communication with the mobile device 302 via the mobile application 318 can include, but are not limited to, scene projectors (e.g., display devices), other firearm training devices 100, servers/hubs, personal computers, other mobile devices, smart targets, and so forth.

In some embodiments, target 306 may be a smart target, and the mobile application 318 may facilitate communications between the mobile device 302 and the smart target. The smart target may be configured to receive instructions from the mobile application 318. For example, the mobile application 318 can send instruction for a predetermined actuation sequence for the smart target, where the smart target moves through a plurality of predetermined target positions based on the actuation sequence. The smart target can additionally or alternatively be configured to transmit shot data to the mobile device 302. For example, the smart target can provide strike indications, timings, and the like.

In some embodiments, the firearm training device can be utilized with a video simulation scenario. For example, the mobile device 302 can be configured to simultaneously activate a shot timer and video simulation. The user 304 can utilize the firearm training device 100 to engage with the video simulation. The mobile device 302 can then provide feedback to the user based on composite images received from the firearm training device 100 during the video simulation.

In some embodiments, the firearm training device 100 can be utilized for multi-user training or gaming scenarios. Multiple fire arm training devices 100 can communicate with a central hub (e.g., server) via the wired or wireless network. For example, each firearm training device 100 can identify with an identification number of a mobile device 100. The mobile devices 100 can communicate via the server to determine when a user 304 has been shot and by which firearm training device 100.

It is to be understood that while the camera 202 provides the primary source of feedback for the user 304, the firearm training device 100 can also be configured to emit light (e.g., a laser beam) to indicate the location of the firearm strike. For example, in embodiments, the strike indicator light 220 (e.g., a laser) is configured to be activated by the trigger pull event. The strike indicator light 220 can provide an immediate source of visible feedback about the location of the firearm strike and the aim of the user.

Figure 5A:
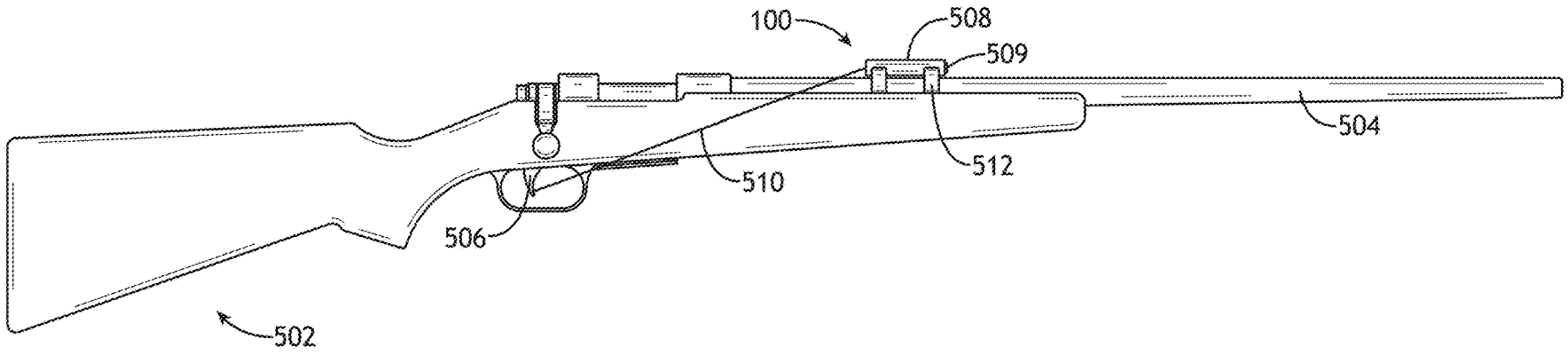
FIG. 5A illustrates a side view of a firearm training device, where the firearm training device is configured as an attachment for a firearm, in accordance with an embodiment of the present disclosure.
Figure 5B:
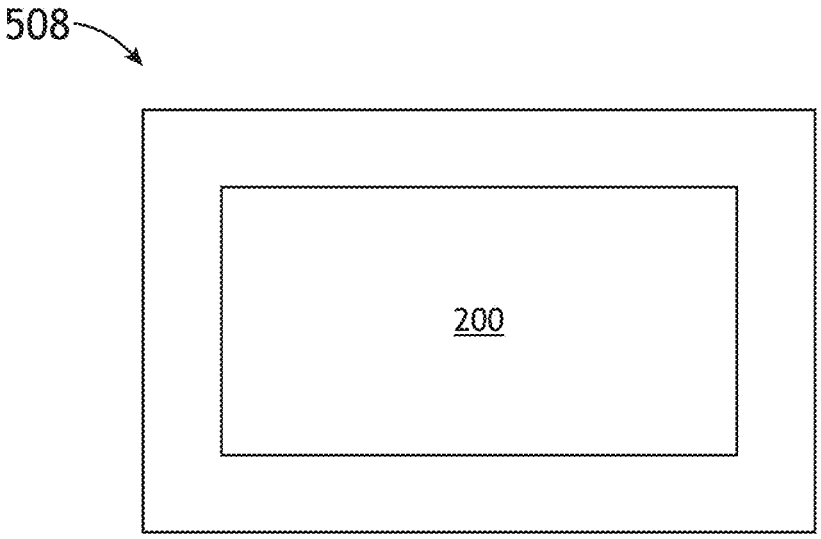
FIG. 5B is a block diagram illustrating a firearm training device, where the firearm training device is configured as an attachment for a firearm, in accordance with an embodiment of the present disclosure.
Figure 5C:
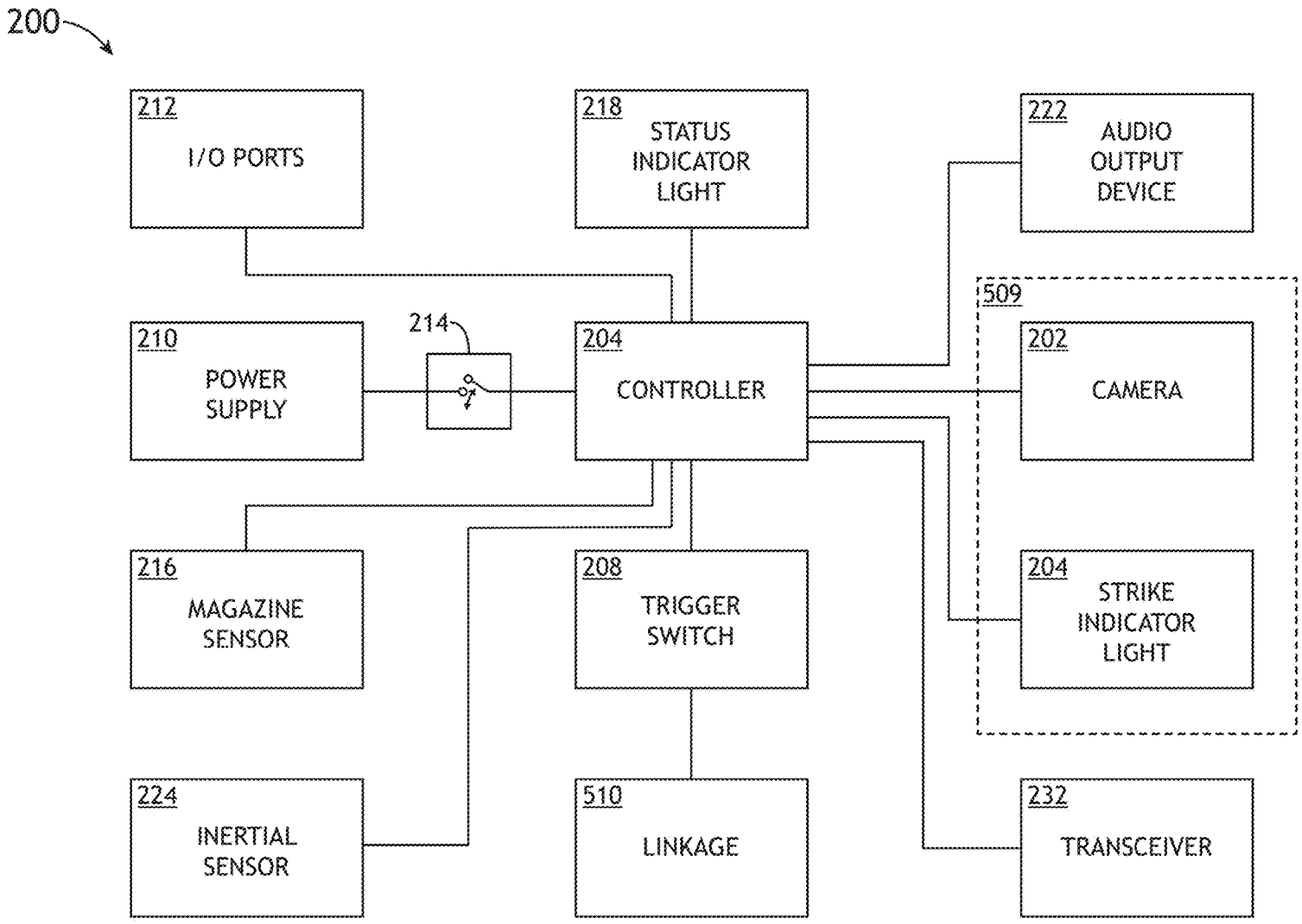
FIG. 5C is a block diagram illustrating an electronic system of a firearm training device, where the firearm training device is configured as an attachment for a firearm, in accordance with an embodiment of the present disclosure.

In an embodiment shown in FIGS. 5A through 5C, the firearm training device 100 is configured as an attachment 508 that can be removably secured to the barrel 504 of a live firearm 502 (e.g., a loaded or unloaded live firearm). For example, the attachment 508 can be secured by one or more fasteners 512 (e.g., clips, clamps, clasps, screws, nuts, bolts, etc.).

As shown in FIG. 5B, the attachment 508 can house at least a portion of the electronic system 200 (e.g., the controller 204, the camera 202, and so forth). For example, FIG. 5C shows an embodiment of the electronic system 200 when the firearm training device 100 is configured as an attachment 508 for a firearm 502. In embodiments, the camera 202 (and optionally a strike indicator light 220) is located at a distal end 509 of the attachment 508.

The attachment 508 can be coupled (physically and/or communicatively) to a trigger 506 of the firearm 502 by a linkage 510 (e.g., as shown in FIG. 5A). For example, the linkage 510 may be a mechanical linkage (e.g., a rod, chain, or cable that actuates a mechanical switch, mechanical interface, or the like). In other embodiments, the linkage 510 comprises a wired or wireless communicative coupling that transmits a signal in response to a trigger pull event. For example, the linkage 510 can include a sensor (e.g., a proximity sensor, reed switch, hall effect sensor, electronic switch, vibration sensor, etc.) that generates a signal when the trigger 506 is pulled. In some embodiments, the linkage 510 is configured to toggle the trigger switch 208 when the trigger 506 of the firearm is 502 pulled (e.g., trigger pull event). For example, the linkage 510 may electrically or mechanically toggle the trigger switch 208. In other embodiments, the linkage 510 itself may transmit a signal to the controller 204 to indicate a trigger pull event. In response to the toggling of the trigger switch 208 and/or the signal indicative of the trigger pull event, the controller 204 is configured to collect an image frame or video segment (e.g., via camera 202). The controller 204 can be further configured to generate a composite image 311 and/or perform a calibration sequence, for example, as described above with regard to embodiments of the firearm training device 100 illustrated in FIGS. 1 through 4C.

Figure 6A:
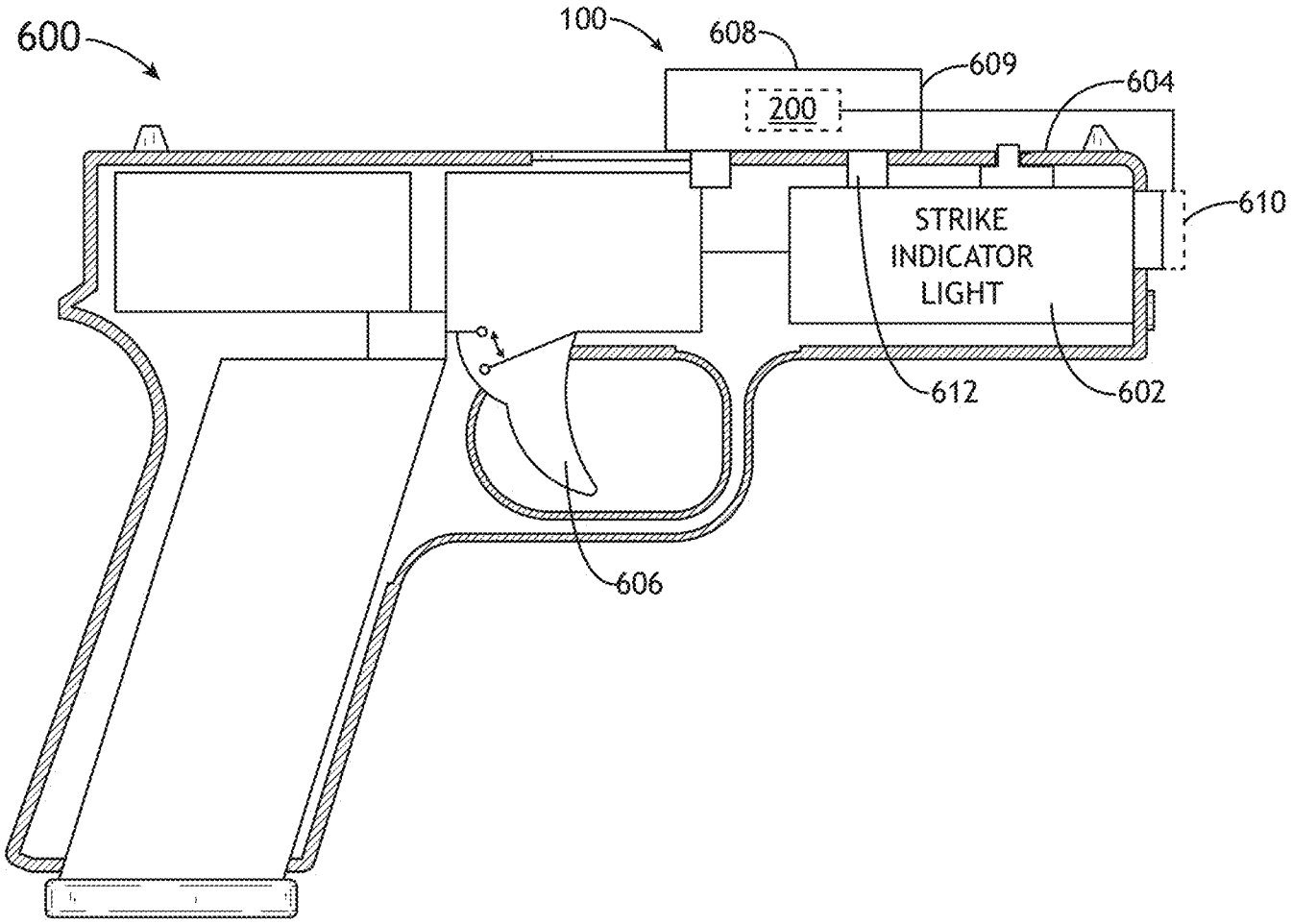
FIG. 6A is a diagrammatic side view of a firearm training device, where the firearm training device is configured as an attachment for a mock firearm that is configured to illuminate a strike location to provide visual feedback for a user when a trigger of the mock firearm is pressed, in accordance with an embodiment of the present disclosure.
Figure 6B:
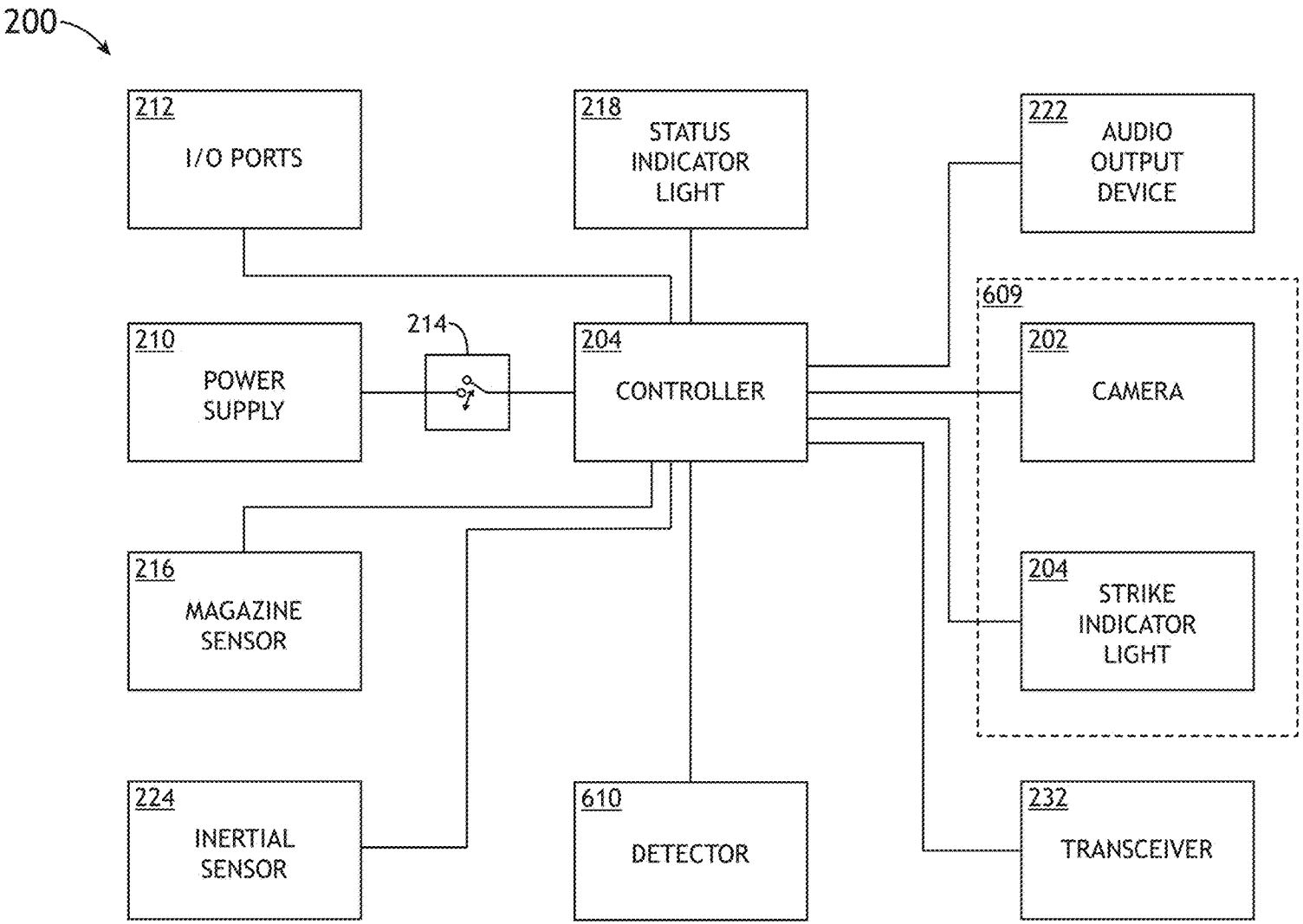
FIG. 6B is a block diagram illustrating an electronic system of a firearm training device, where the firearm training device is configured as an attachment for a mock firearm that is configured to illuminate a strike location to provide visual feedback for a user when a trigger of the mock firearm is pressed, in accordance with an embodiment of the present disclosure.

In an embodiment shown in FIGS. 6A and 6B, the firearm training device 100 is configured as an attachment 608 that can be removably secured to the barrel 604 of a training/mock firearm 600. For example, the attachment 608 can be secured by one or more fasteners 612 (e.g., clips, clamps, clasps, screws, nuts, bolts, etc.). The training/mock firearm 600 can include a strike indicator light 602 (e.g., an LED, a laser, or the like) that is configured to emit illumination (e.g., a laser beam) when a trigger 606 of the training/mock firearm 600 is pulled. For example, the training/mock firearm 600 can be configured to illuminate a strike location to provide visual feedback for a user when the trigger 606 is pressed.

The attachment 608 can house at least a portion of the electronic system 200 (e.g., the controller 204, the camera 202, and so forth). The attachment 608 includes or is coupled to a light detector 610 that can be removably secured to the training/mock firearm 600 so that the detector 610 is configured to detect at least a portion of the illumination emitted by the strike indicator light 602. In some embodiments, the attachment 608 includes its own strike indicator light 220 so that the attachment can be used to illuminate a strike location when the trigger 606 (e.g., in the event the detector 610 completely or substantially covers the strike indicator light 602 of the training/mock firearm 600).

FIG. 6B shows an embodiment of the electronic system 200 when the firearm training device 100 is configured as an attachment 608 for a training/mock firearm 600. In embodiments, the camera 202 (and optionally a strike indicator light 220) is located at a distal end 609 of the attachment 608. The detector 610 can be communicatively coupled to the controller 204 and configured to detect illumination generated by the training/mock firearm 600 (e.g., illumination emitted by the strike indicator light 602). The detector 620 can generate a signal indicative of a trigger pull event in response to detecting the illumination generated by the training/mock firearm 600, where the controller 204 is configured to collect an image frame or video segment (e.g., via camera 202) in response to the signal generated by the light detector 610. The controller 204 can be further configured to generate a composite image 311 and/or perform a calibration sequence, for example, as described above with regard to embodiments of the firearm training device 100 illustrated in FIGS. 1 through 4C.

Conclusion

It is to be understood that the present application is defined by the appended claims. Although embodiments of the present application have been illustrated and described herein, it is apparent that various modifications may be made by those skilled in the art without departing from the scope and spirit of this disclosure.

What is claimed is:

1. A firearm training device, comprising:

a firearm frame, the firearm frame including a barrel and a grip attached to the barrel;

a camera disposed at a distal end of the barrel;

a wireless transceiver;

a trigger in proximity to the grip, the trigger configured to toggle an electronic switch; and a controller communicatively coupled to the camera, the wireless transceiver, and the electronic switch, the controller configured to:

collect an image frame or video segment, via the camera, when the electronic switch is toggled;

generate a composite image or video including the image frame or video segment and a strike indicator overlaid onto the image frame or video segment, whereby the composite image or video demonstrates where a firearm strike would have occurred;

transmit the composite image or video to a mobile device by: transmitting, via the wireless transceiver, a file identifier and a time stamp associated with the composite image or video to the mobile device; and transmitting, via the wireless transceiver, the composite image or video to the mobile device after receiving a request including the file identifier from the mobile device;

receive, via the wireless transceiver, a signal from the mobile device indicating a start time; and determine a reaction time by subtracting the start time from the time stamp associated with the composite image or video.

2. The firearm training device of claim 1, further comprising an audio output device, wherein the audio output device is configured to generate an audio output in response to the signal from the mobile device indicating the start time.

3. The firearm training device of claim 1, further comprising:

an accelerometer communicatively coupled to the controller, wherein the controller is further configured to determine a firing time based upon a time difference between receiving a signal from the accelerometer indicating drawing of the firearm training device and the time stamp associated with the composite image or video.

4. The firearm training device of claim 1, wherein the controller is further configured to calibrate the strike indicator by:

collecting a first image frame, via the camera, when the electronic switch is toggled;

generating a first composite image including the first image frame and a first strike indicator overlaid onto the first image frame;

transmitting, via the wireless transceiver, the first composite image to the mobile device; and receiving, via the wireless transceiver, coordinates from the mobile device, wherein the coordinates are based on one or more user inputs to the mobile device, whereby the user repositions the first strike indicator to a user-defined position associated with sights on the firearm frame.

5. The firearm training device of claim 1, wherein the camera includes or is coupled to a zoom lens that controls a magnification and field of view of the image frame or video segment collected via the camera.

6. The firearm training device of claim 1, further comprising a light emitter configured to illuminate a strike location when the electronic switch is toggled to provide visual feedback for a user.

7. A firearm training device, comprising:

an attachment for a firearm;

a camera disposed at a distal end of the attachment;

a wireless transceiver;

a linkage configured to toggle an electronic switch when a trigger of the firearm is pressed; and a controller disposed within or coupled to the attachment, the controller communicatively coupled to the camera, the wireless transceiver, and the electronic switch, the controller configured to:

collect an image frame or video segment, via the camera, when the electronic switch is toggled;

generate a composite image or video including the image frame or video segment and a strike indicator overlaid onto the image frame or video segment, whereby the composite image or video demonstrates where a firearm strike would have occurred;

transmit the composite image or video to a mobile device by: transmitting, via the wireless transceiver, a file identifier and a time stamp associated with the composite image or video to the mobile device; and transmitting, via the wireless transceiver, the composite image or video to the mobile device after receiving a request including the file identifier from the mobile device;

receive, via the wireless transceiver, a signal from the mobile device indicating a start time; and determine a reaction time by subtracting the start time from the time stamp associated with the composite image or video.

8. The firearm training device of claim 7, wherein the attachment further includes an audio output device, wherein the audio output device is configured to generate an audio output in response to the signal from the mobile device indicating the start time.

9. The firearm training device of claim 7, wherein the attachment further includes an accelerometer communicatively coupled to the controller, wherein the controller is further configured to determine a firing time based upon a time difference between receiving a signal from the accelerometer indicating drawing of the firearm training device and the time stamp associated with the composite image or video.

10. The firearm training device of claim 7, wherein the controller is further configured to calibrate the strike indicator by:

collecting a first image frame, via the camera, when the electronic switch is toggled;

generating a first composite image including the first image frame and a first strike indicator overlaid onto the first image frame;

transmitting, via the wireless transceiver, the first composite image to the mobile device; and receiving, via the wireless transceiver, coordinates from the mobile device, wherein the coordinates are based on one or more user inputs to the mobile device, whereby the user repositions the first strike indicator to a user-defined position associated with sights on the firearm.

11. The firearm training device of claim 7, wherein the camera includes or is coupled to a zoom lens that controls a magnification and field of view of the image frame or video segment collected via the camera.

12. The firearm training device of claim 7, wherein the attachment further includes a light emitter configured to illuminate a strike location when the electronic switch is toggled to provide visual feedback for a user.

13. The firearm training device of claim 7, wherein the linkage is configured to physically or electrically toggle the electronic switch when the trigger is pressed.

14. A firearm training device, comprising:

an attachment for a mock firearm, the mock firearm configured to illuminate a strike location to provide visual feedback for a user when a trigger of the mock firearm is pressed;

a wireless transceiver;

a camera disposed at a distal end of the attachment;

a light detector configured to detect illumination generated by the mock firearm and generate a signal in response to detecting the illumination generated by the mock firearm; and a controller disposed within or coupled to the attachment, the controller communicatively coupled to the camera, the wireless transceiver, and the light detector, the controller configured to:

collect an image frame or video segment, via the camera, in response to the signal generated by the light detector;

generate a composite image or video including the image frame or video segment and a strike indicator overlaid onto the image frame or video segment, whereby the composite image or video demonstrates where a firearm strike would have occurred;

transmit the composite image or video to a mobile device by: transmitting, via the wireless transceiver, a file identifier and a time stamp associated with the composite image or video to the mobile device; and transmitting, via the wireless transceiver, the composite image or video to the mobile device after receiving a request including the file identifier from the mobile device;

receive, via the wireless transceiver, a signal from the mobile device indicating a start time; and determine a reaction time by subtracting the start time from the time stamp associated with the composite image or video.

15. A firearm training device, comprising:

a firearm frame, the firearm frame including a barrel and a grip attached to the barrel;

a camera disposed at a distal end of the barrel;

a wireless transceiver;

an accelerometer;

a trigger in proximity to the grip, the trigger configured to toggle an electronic switch; and a controller communicatively coupled to the camera, the wireless transceiver, the accelerometer, and the electronic switch, the controller configured to:

collect an image frame or video segment, via the camera, when the electronic switch is toggled;

generate a composite image or video including the image frame or video segment and a strike indicator overlaid onto the image frame or video segment, whereby the composite image or video demonstrates where a firearm strike would have occurred;

transmit the composite image or video to a mobile device by: transmitting, via the wireless transceiver, a file identifier and a time stamp associated with the composite image or video to the mobile device; and transmitting, via the wireless transceiver, the composite image or video to the mobile device after receiving a request including the file identifier from the mobile device; and determine a firing time based upon a time difference between receiving a signal from the accelerometer indicating drawing of the firearm training device and the time stamp associated with the composite image or video.

16. A firearm training device, comprising:

a firearm frame, the firearm frame including a barrel and a grip attached to the barrel;

a camera disposed at a distal end of the barrel;

a wireless transceiver;

a trigger in proximity to the grip, the trigger configured to toggle an electronic switch; and a controller communicatively coupled to the camera, the wireless transceiver, and the electronic switch, the controller configured to:

collect an image frame or video segment, via the camera, when the electronic switch is toggled;

generate a composite image or video including the image frame or video segment and a strike indicator overlaid onto the image frame or video segment, whereby the composite image or video demonstrates where a firearm strike would have occurred;

transmit the composite image or video to a mobile device by: transmitting, via the wireless transceiver, a file identifier and a time stamp associated with the composite image or video to the mobile device; and transmitting, via the wireless transceiver, the composite image or video to the mobile device after receiving a request including the file identifier from the mobile device; and calibrate the strike indicator by: collecting a first image frame, via the camera, when the electronic switch is toggled; generating a first composite image including the first image frame and a first strike indicator overlaid onto the first image frame; transmitting, via the wireless transceiver, the first composite image to the mobile device; and receiving, via the wireless transceiver, coordinates from the mobile device, wherein the coordinates are based on one or more user inputs to the mobile device, whereby the user repositions the first strike indicator to a user-defined position associated with sights on the firearm frame.

17. A firearm training device, comprising:

an attachment for a firearm;

a camera disposed at a distal end of the attachment;

a wireless transceiver;

an accelerometer;

a linkage configured to toggle an electronic switch when a trigger of the firearm is pressed; and a controller disposed within or coupled to the attachment, the controller communicatively coupled to the camera, the wireless transceiver, the accelerometer, and the electronic switch, the controller configured to:

collect an image frame or video segment, via the camera, when the electronic switch is toggled;

generate a composite image or video including the image frame or video segment and a strike indicator overlaid onto the image frame or video segment, whereby the composite image or video demonstrates where a firearm strike would have occurred;

transmit the composite image or video to a mobile device by: transmitting, via the wireless transceiver, a file identifier and a time stamp associated with the composite image or video to the mobile device; and transmitting, via the wireless transceiver, the composite image or video to the mobile device after receiving a request including the file identifier from the mobile device; and determine a firing time based upon a time difference between receiving a signal from the accelerometer indicating drawing of the firearm training device and the time stamp associated with the composite image or video.

18. A firearm training device, comprising:

an attachment for a firearm;

a camera disposed at a distal end of the attachment;

a wireless transceiver;

a linkage configured to toggle an electronic switch when a trigger of the firearm is pressed; and a controller disposed within or coupled to the attachment, the controller communicatively coupled to the camera, the wireless transceiver, and the electronic switch, the controller configured to:

collect an image frame or video segment, via the camera, when the electronic switch is toggled;

generate a composite image or video including the image frame or video segment and a strike indicator overlaid onto the image frame or video segment, whereby the composite image or video demonstrates where a firearm strike would have occurred;

transmit the composite image or video to a mobile device by: transmitting, via the wireless transceiver, a file identifier and a time stamp associated with the composite image or video to the mobile device; and transmitting, via the wireless transceiver, the composite image or video to the mobile device after receiving a request including the file identifier from the mobile device; and calibrate the strike indicator by: collecting a first image frame, via the camera, when the electronic switch is toggled; generating a first composite image including the first image frame and a first strike indicator overlaid onto the first image frame; transmitting, via the wireless transceiver, the first composite image to the mobile device; and receiving, via the wireless transceiver, coordinates from the mobile device, wherein the coordinates are based on one or more user inputs to the mobile device, whereby the user repositions the first strike indicator to a user-defined position associated with sights on the firearm frame.

19. A firearm training device, comprising:

an attachment for a mock firearm, the mock firearm configured to illuminate a strike location to provide visual feedback for a user when a trigger of the mock firearm is pressed;

a wireless transceiver;

an accelerometer;

a camera disposed at a distal end of the attachment;

a light detector configured to detect illumination generated by the mock firearm and generate a signal in response to detecting the illumination generated by the mock firearm; and a controller disposed within or coupled to the attachment, the controller communicatively coupled to the camera, the wireless transceiver, the accelerometer, and the light detector, the controller configured to:

collect an image frame or video segment, via the camera, in response to the signal generated by the light detector;

generate a composite image or video including the image frame or video segment and a strike indicator overlaid onto the image frame or video segment, whereby the composite image or video demonstrates where a firearm strike would have occurred;

transmit the composite image or video to a mobile device by: transmitting, via the wireless transceiver, a file identifier and a time stamp associated with the composite image or video to the mobile device; and transmitting, via the wireless transceiver, the composite image or video to the mobile device after receiving a request including the file identifier from the mobile device; and determine a firing time based upon a time difference between receiving a signal from the accelerometer indicating drawing of the firearm training device and the time stamp associated with the composite image or video.

20. A firearm training device, comprising:

an attachment for a mock firearm, the mock firearm configured to illuminate a strike location to provide visual feedback for a user when a trigger of the mock firearm is pressed;

a wireless transceiver;

a camera disposed at a distal end of the attachment;

a light detector configured to detect illumination generated by the mock firearm and generate a signal in response to detecting the illumination generated by the mock firearm; and a controller disposed within or coupled to the attachment, the controller communicatively coupled to the camera, the wireless transceiver, and the light detector, the controller configured to:

collect an image frame or video segment, via the camera, in response to the signal generated by the light detector;

generate a composite image or video including the image frame or video segment and a strike indicator overlaid onto the image frame or video segment, whereby the composite image or video demonstrates where a firearm strike would have occurred;

transmit the composite image or video to a mobile device by: transmitting, via the wireless transceiver, a file identifier and a time stamp associated with the composite image or video to the mobile device; and transmitting, via the wireless transceiver, the composite image or video to the mobile device after receiving a request including the file identifier from the mobile device; and calibrate the strike indicator by: collecting a first image frame, via the camera, in response to the signal generated by the light detector; generating a first composite image including the first image frame and a first strike indicator overlaid onto the first image frame; transmitting, via the wireless transceiver, the first composite image to the mobile device; and receiving, via the wireless transceiver, coordinates from the mobile device, wherein the coordinates are based on one or more user inputs to the mobile device, whereby the user repositions the first strike indicator to a user-defined position associated with sights on the mock firearm.

* * * * *